US010809030B2

(12) United States Patent
Geissele et al.

(10) Patent No.: US 10,809,030 B2
(45) Date of Patent: Oct. 20, 2020

(54) TRIGGER ASSEMBLIES FOR FIREARMS

(71) Applicant: WHG Properties, LLC, North Wales, PA (US)

(72) Inventors: William H. Geissele, Lower Gwynedd, PA (US); David Duhaime, Ivyland, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/141,461

(22) Filed: Sep. 25, 2018

(65) Prior Publication Data

US 2020/0096275 A1 Mar. 26, 2020

(51) Int. Cl.
*F41A 19/10* (2006.01)
*F41A 3/66* (2006.01)
*F41A 19/12* (2006.01)

(52) U.S. Cl.
CPC ..... *F41A 19/10* (2013.01); *F41A 3/66* (2013.01); *F41A 19/12* (2013.01)

(58) Field of Classification Search
CPC ..... F41A 17/30; F41A 19/10; F41A 19/12
USPC ..... 42/69.02, 70.04; 89/144
See application file for complete search history.

(56) References Cited

U.S. PATENT DOCUMENTS 2,514,981 A * 7/1950 Walker ..... F41A 17/32 42/70.01
2,675,638 A * 4/1954 Crittendon ..... F41A 19/45 42/69.01
2,856,717 A * 10/1958 Parke ..... F41A 19/17 42/69.02
2,856,718 A * 10/1958 Fischer ..... F41A 17/46 42/70.05
2,869,269 A * 1/1959 Couture ..... F41A 17/32 42/70.06
3,129,637 A * 4/1964 Packard ..... F41A 19/44 89/154
3,707,796 A * 1/1973 Bielfeldt ..... F41A 17/56 42/70.05
4,719,841 A * 1/1988 Perrine ..... F41A 3/50 42/70.04
4,754,567 A * 7/1988 Lehfeldt ..... F41A 19/17 42/69.01
4,870,770 A * 10/1989 Forbes ..... F41A 17/32 42/70.01
4,897,951 A * 2/1990 Osborne ..... F41A 17/46 42/69.02

(Continued)

*Primary Examiner* — Stephen Johnson
*Assistant Examiner* — Benjamin S Gomberg
(74) *Attorney, Agent, or Firm* — Fox Rothschild LLP

(57) ABSTRACT

Trigger assemblies are provided for initiating the discharge of a firearm. The triggers assemblies include a first and a second lever mounted for rotation within a housing. The first lever is configured to be rotated by the user, and rotation of the first lever imparts rotation to the second lever to initiate the discharge of the firearm. The trigger assemblies have a safety mechanism that includes an interfering member configured to be positioned in proximity to the first and the second levers on a selective basis so that the interfering member simultaneously interferes with movement of both the first and the second levers, and thereby provides multiple points of interference that each prevent discharge of the firearm.

25 Claims, 13 Drawing Sheets

(56) References Cited

U.S. PATENT DOCUMENTS

| | | | | | |
|---|---|---|---|---|---|
| 5,149,898 | A * | 9/1992 | Chesnut | F41A 9/65 | 42/69.01 |
| 5,303,494 | A * | 4/1994 | Tuma | F41A 17/56 | 42/70.04 |
| 6,073,380 | A * | 6/2000 | Hauser | F41A 17/32 | 42/69.02 |
| 8,677,665 | B1 * | 3/2014 | Huber | F41A 19/12 | 42/69.01 |
| 8,966,802 | B1 * | 3/2015 | Findlay | F41A 19/12 | 42/69.01 |

* cited by examiner

TRIGGER ASSEMBLIES FOR FIREARMS

FIELD

The inventive concepts disclosed herein relate to trigger assemblies for initiating the firing sequence in firearms such as bolt action rifles.

BACKGROUND

Firearms such as rifles and handguns typically include a trigger assembly by which the user initiates the firing sequence that results in the discharge of the firearm. A trigger assembly configured for use with a bolt-action rifle commonly includes a mechanism for restraining a spring-loaded firing pin that, when released, strikes a primer of an unfired cartridge located in a chamber of the rifle. The impact ignites the primer, which in turn ignites a propellant within the cartridge. The expanding propellant drives a projectile from a casing of the cartridge and through a barrel of the firearm so that the projectile exits the rifle via the muzzle of the barrel.

The trigger assembly restrains the firing pin until the user actuates the trigger assembly by pulling or otherwise exerting pressure on a rotating or linear-motion trigger. Pulling the trigger initiates a series of mechanical interactions within the trigger assembly that result in the release of the firing pin.

The trigger assembly is critical to the safe, reliable, and accurate operation of the rifle. For example, the trigger assembly needs to securely restrain the firing pin so as to minimize the potential for an accidental discharge of the rifle. Configuring the trigger assembly to avoid an accidental discharge, however, can give the trigger assembly undesirable characteristics. The degree of restraint on the firing pin can be increased, and the potential for an accidental discharge decreased, by increasing the friction and the overlap between the various components within the trigger assembly that interact to restrain the firing pin. Increasing the friction and overlap between components, however, can increase the trigger pull weight, i.e., the amount of force that needs to be applied to the trigger; can make the trigger pull rough and uneven; and can increase the distance through which the trigger must be pulled to initiate the firing sequence. These factors can diminish the accuracy and reliability of the rifle; can result in premature wear of the trigger assembly; and can cause fatigue, discomfort, and injury to the user.

Trigger assemblies typically include some type of safety mechanism that further reduces the potential for an accidental discharge when the rifle is not in use. Safety mechanisms usually function by blocking or otherwise interfering with the movement of a single component within the trigger assembly, so that the trigger assembly cannot be actuated. Blocking a single component, however, may be not be sufficient to prevent an accidental discharge, especially when the rifle is dropped or otherwise subjected to some type of impact. On the other hand, a safety mechanism that interferes with the movement of multiple components may be too large, and may require the user to manipulate more than one lever or button to fully engage and disengage the mechanism.

The space allocated for the trigger assembly within a rifle typically is limited, which in turn limits the overall dimensions of the trigger assembly. Also, trigger assemblies are exposed to dirt, carbon, and other contaminants during normal use, and thus need to be cleaned and lubricated on a periodic basis. Trigger assemblies that require significant disassembly to clean and lubricate, or that otherwise are difficult to maintain, often do not receive a proper degree of maintenance.

SUMMARY

The present disclosure relates generally to trigger assemblies for initiating the discharge of a firearm.

In one aspect, the disclosed technology relates to a trigger assembly for restraining a firing pin of a firearm on a selective basis, the trigger assembly including: a housing; a first lever mounted for rotation on the housing and movable between a first and a second angular position of the first lever; a second lever mounted for rotation on the housing and movable between a first and a second angular position of the second lever, wherein the first lever is configured to move the second lever from the first to the second angular position of the second lever when the first lever moves from the first to the second angular position of the first lever; and a safety mechanism including: a first interfering member configured to be positioned in proximity to the first and the second levers on a selective basis so that the first interfering member simultaneously interferes with movement of the first lever from the first to the second angular position of the first lever, and movement of the second lever from the first to the second angular position of the second lever.

In one embodiment, the safety mechanism further includes a safety lever mounted for rotation in relation to the housing and movable between a first and a second angular position of the safety lever; the safety lever includes the first interfering member; and the safety lever is configured so that the first interfering member is positioned in proximity to the first and the second levers when the safety lever is in the second angular position of the safety lever. In another embodiment, the trigger assembly further includes a third lever mounted for rotation on the housing and movable between a first and a second angular position of the third lever; wherein: the second lever is configured to move the third lever from the first to the second angular position of the third lever when the second lever moves from the first to the second angular position of the second lever; the safety lever further includes a second interfering member configured to be positioned in proximity to the third lever when the safety lever is in the second angular position of the safety lever, so that the second interfering member interferes with movement of the third lever from the first to the second angular position of the third lever. In another embodiment, the trigger assembly further includes a cover plate mounted on the housing, wherein the safety lever is mounted for rotation on an exterior of the cover plate. In another embodiment, the second interfering member is configured to extend through an aperture in the cover plate and into an interior of the housing. In another embodiment, the trigger assembly further includes a guide located on the cover plate and configured to engage the safety lever as the safety lever moves between the first and the second angular positions of the safety lever. In another embodiment, the first and the second interfering members include tabs.

In another embodiment, the first interfering member is configured to not interfere with movement of the first lever from the first to the second angular position of the first lever, and movement of the second lever from the first to the second angular position of the second lever when the safety lever is in the first angular portion of the safety lever; and the second interfering member is configured to not interfere with movement of the third lever from the first to the second position of the third lever when the safety lever is in the first angular portion of the safety lever. In another embodiment, the first interfering member is configured to be positioned between the first and the second levers when the safety lever is in the second angular position of the safety lever. In another embodiment, the housing includes a first and a second alignment post each configured to engage the cover plate and to maintain the housing and the cover plate in a state of alignment. In another embodiment, the housing has a port formed in an exterior surface of the housing, and a passage formed within the housing; and the passage is in fluid communication with the port and at least one of the first and second levers.

In another embodiment, the housing and the cover plate each have a plurality of raised surface portions formed thereon, and the housing and the cover plate contact at least one of the first, second, and third levers by way of the raised surface portions. In another embodiment, at least one of the first, second, and third levers has a plurality of raised surface portions formed thereon, and the least one of the first, second, and third levers contacts the housing and the cover plate by way of the raised surface portions. In another embodiment, the cover plate has a threaded aperture formed therein and positioned adjacent a solid surface of the housing. In another embodiment, the trigger assembly further includes a spring configured to bias the first lever toward the first angular position of the first lever; and a ball positioned between the spring and the first lever. In another embodiment, the first lever has a beveled surface; and the first lever is configured so that the ball is captured between the beveled surface and the housing. In another embodiment, the trigger assembly further includes a spring plunger configured to bias the second lever toward the first angular position of the second lever; wherein the spring plunger includes a casing, and a spring positioned at least in part within the casing. In another embodiment, an end of the casing faces a surface of the second lever; a first portion of the end contacts the surface; a second portion of the end is spaced from the surface; and the first and the second portions are located on opposite sides of a centerline of the spring plunger. In another embodiment, the second interfering member is configured to interfere with movement of the casing when the safety lever is in the second angular position of the safety lever. In another embodiment, the third lever is configured to restrain the firing pin when the third lever is in the first position of the third lever.

BRIEF DESCRIPTION OF THE DRAWINGS

Embodiments will be described with reference to the following drawing figures, in which like reference numerals represent like parts and assemblies throughout the several views.

DETAILED DESCRIPTION

The inventive concepts are described with reference to the attached figures. The figures are not drawn to scale and are provided merely to illustrate the instant inventive concepts. The figures do not limit the scope of the present disclosure. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts.

FIGS. 1-18 depict a trigger assembly 10, and various components thereof. The trigger assembly 10 can be used in a firearm such as a SOCOM MK 13 bolt-action sniper rifle shown in FIG. 1. This particular application is disclosed for exemplary purposes only; the trigger 10 can be used in other types of bolt-action rifles.

Figure 1:
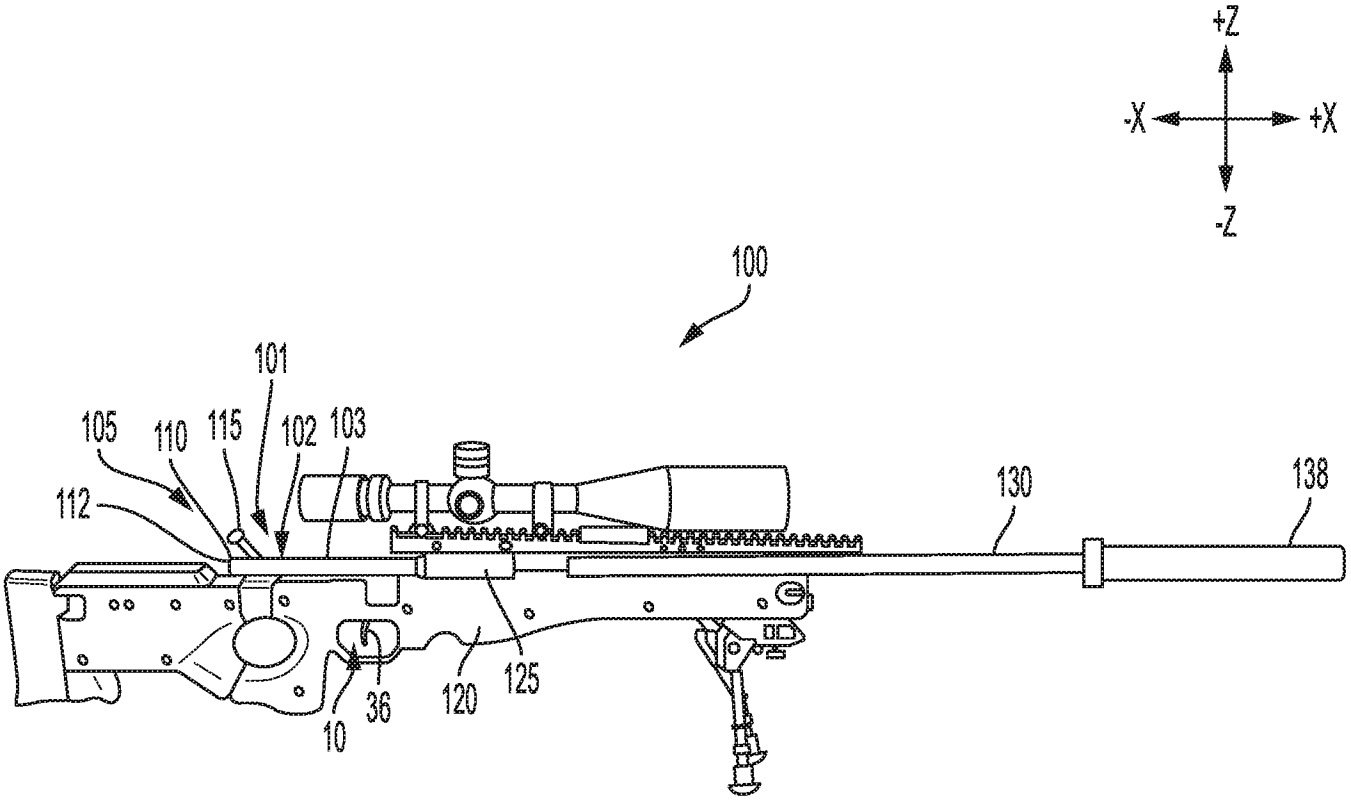
FIG. 1 is side view of a rifle having a trigger assembly as described below.

Referring to FIG. 1, the rifle 100 comprises an action 101. The action 101 is a rotating bolt action, and comprises a bolt assembly 102; a receiver 103; and a striker 105. The receiver 103 is mounted on a stock 120 of the rifle, and houses the bolt assembly 102. The bolt assembly 102 is movable within the receiver 103 between a forward, or closed position; and a rearward, or open position shown in FIG. 1. The bolt assembly 102 includes a bolt body 113, a bolt head (not shown) secured to a forward end of the bolt body 113, and a bolt handle 115 secured to a rearward end of the bolt body 113.

The striker 105 includes a firing pin 106, a spring (not shown), a bolt shroud 110, and a cocking piece 112. The bolt shroud 110 is secured to a rearward end of the bolt body 113. The firing pin 106 extends through the bolt shroud 110; and moves linearly, in the forward and rearward, or "x" directions, in relation to the bolt shroud 110. The spring is positioned around the firing pin 106, and biases the firing pin 106 in the forward direction. The cocking piece 112 is secured to a rearward end of the firing pin 106, and is biased in the forward direction due to its attachment to the forwardly-biased firing pin 106.

Following discharge of the rifle 10, an unfired cartridge is introduced into the action 101 by moving the bolt assembly 102 from its closed to its open position. As the empty casing of the fired cartridge is carried rearward with the bolt assembly 102, an ejector (not shown) on the bolt head strips the empty casing from the bolt assembly 102 and ejects the casing through a loading ejection port 125 in the receiver 103. An unfired cartridge is then introduced into the receiver 103, forward of the bolt head.

Figure 9:
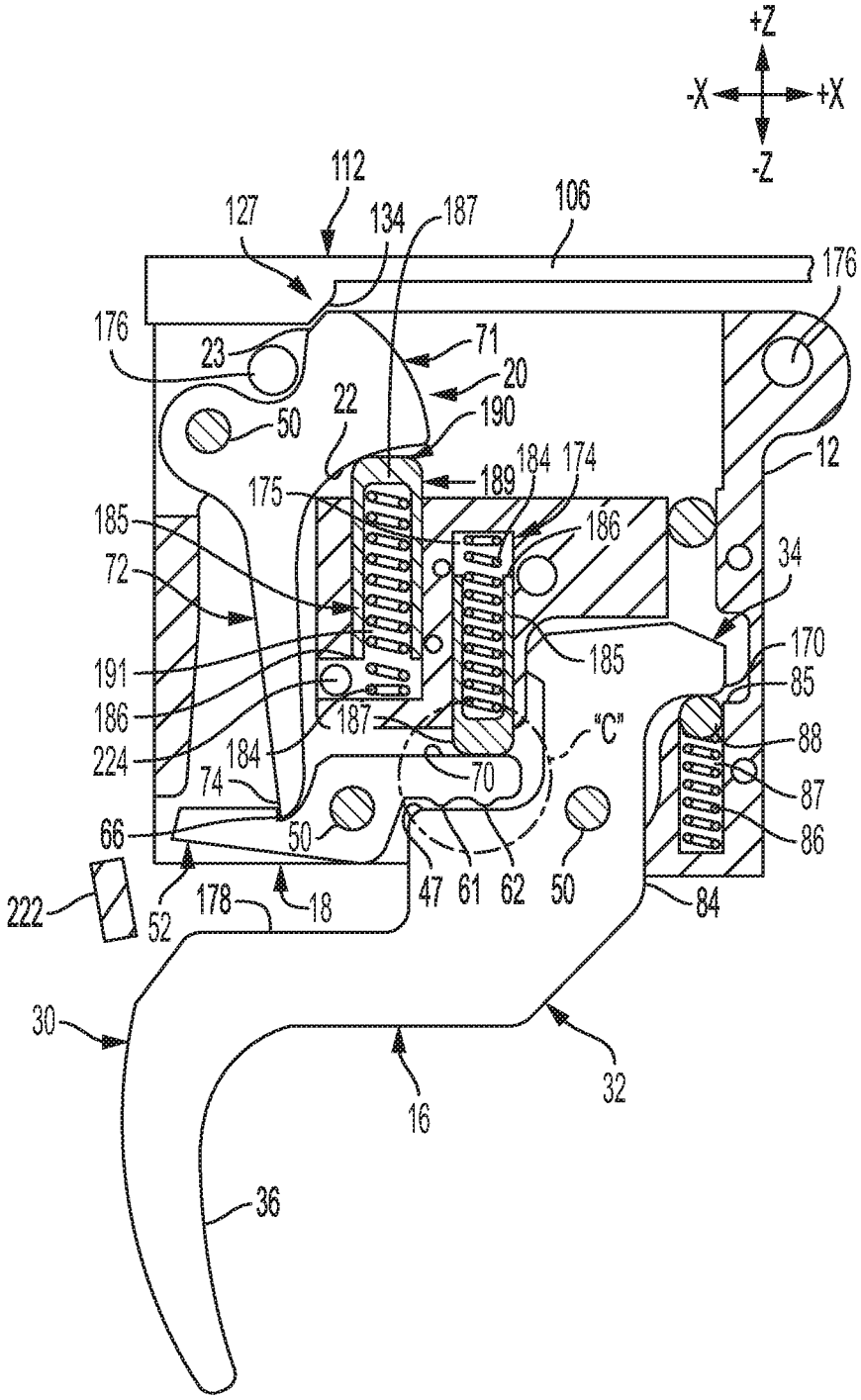
FIG. 9 is a cross-sectional view of the trigger assembly shown in FIGS. 2-8, taken through the line "A-A" of FIG. 8, showing: the safety lever in the unlocked position; the trigger lever, the re-cocking lever, and the sear lever in their respective rest positions; and a cocking piece of the rifle being restrained by the sear lever.

Once the unfired cartridge has been fed into the receiver 103, the user pushes the bolt assembly 102 forward, toward its cocked position. The bolt head pushes the unfired cartridge forward as the bolt assembly 102 moves toward its closed position. As the bolt assembly 102 and the attached striker 105 move forward, a lip 127 on the cocking piece 112 catches on a sear lever 20 of the trigger assembly 10, as shown in FIG. 9. The sear lever 20 restrains the cocking piece 112, and the attached firing pin 106, from further forward movement. As the bolt assembly 102 moves further forward, the spring of the striker 105 becomes further compressed. As the bolt assembly 102 reaches its forward position, it pushes the unfired cartridge into a barrel chamber (not shown) of a barrel 130 of the rifle 100.

Figure 10:
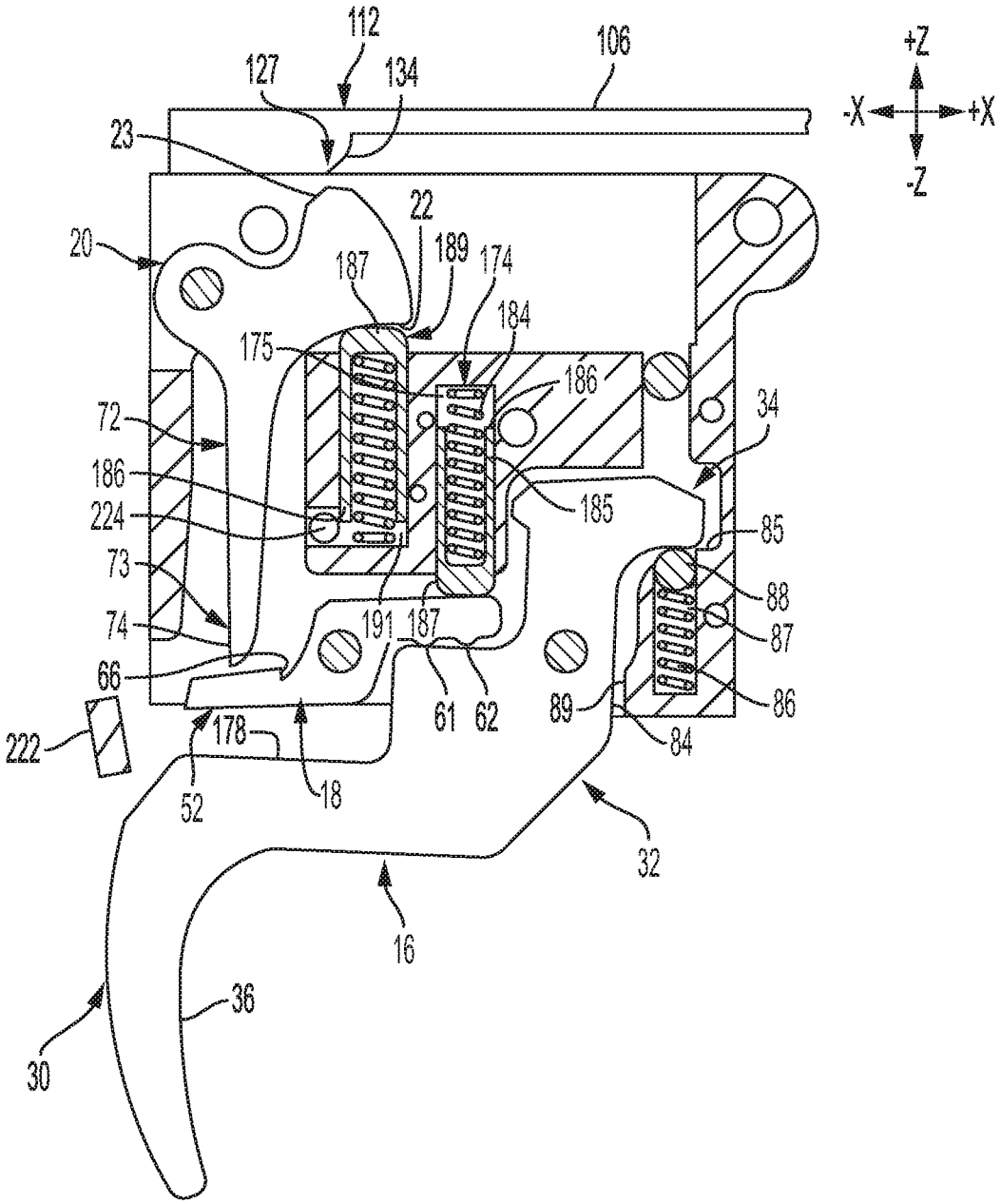
FIG. 10 is a cross-sectional view of the trigger assembly shown in FIGS. 2-9, taken through the line "A-A" of FIG. 8, showing: the safety lever in the unlocked position; the trigger lever, the re-cocking lever, and the sear lever immediately after actuation of the trigger mechanism; and the cocking piece immediately after being released by the sear lever.

Subsequent actuation of the trigger assembly 10 causes the sear lever 20 to release the cocking piece 112, which in turn allows the firing pin 106 to move forward under the bias of the spring of the striker 105, as can be seen in FIG. 10. A forward end of the firing pin 106 subsequently strikes the cartridge, which ignites an impact-sensitive primer in the cartridge. The primer ignites a propellant within the cartridge; and the expanding propellant gas propels a projectile of the cartridge out of the barrel chamber, and through a bore formed in the barrel 130 adjacent to the barrel chamber. The projectile subsequently exits the open end, or muzzle 138 of the barrel 130.

Structure of the Trigger Mechanism

The trigger assembly 10 comprises a housing 12, and a cover plate 14 that mates with the housing 12. The trigger assembly 10 is attached to the receiver 103 by two press fit pins that extend through apertures 176 in the housing 12. The assembly 10 also comprises a first lever in the form of a trigger lever 16; a second lever in the form of a re-cocking lever 18; and a third lever in the form of the sear lever 20, each of which is pivotally mounted on the housing 12 and the cover plate 14. The trigger lever 16, re-cocking lever 18, and sear lever 20 interact mechanically in a manner that causes the firing pin 106 of the striker 105 to be restrained in its cocked position until the trigger assembly 10 is actuated by the user.

a. Trigger Lever

Figure 5:
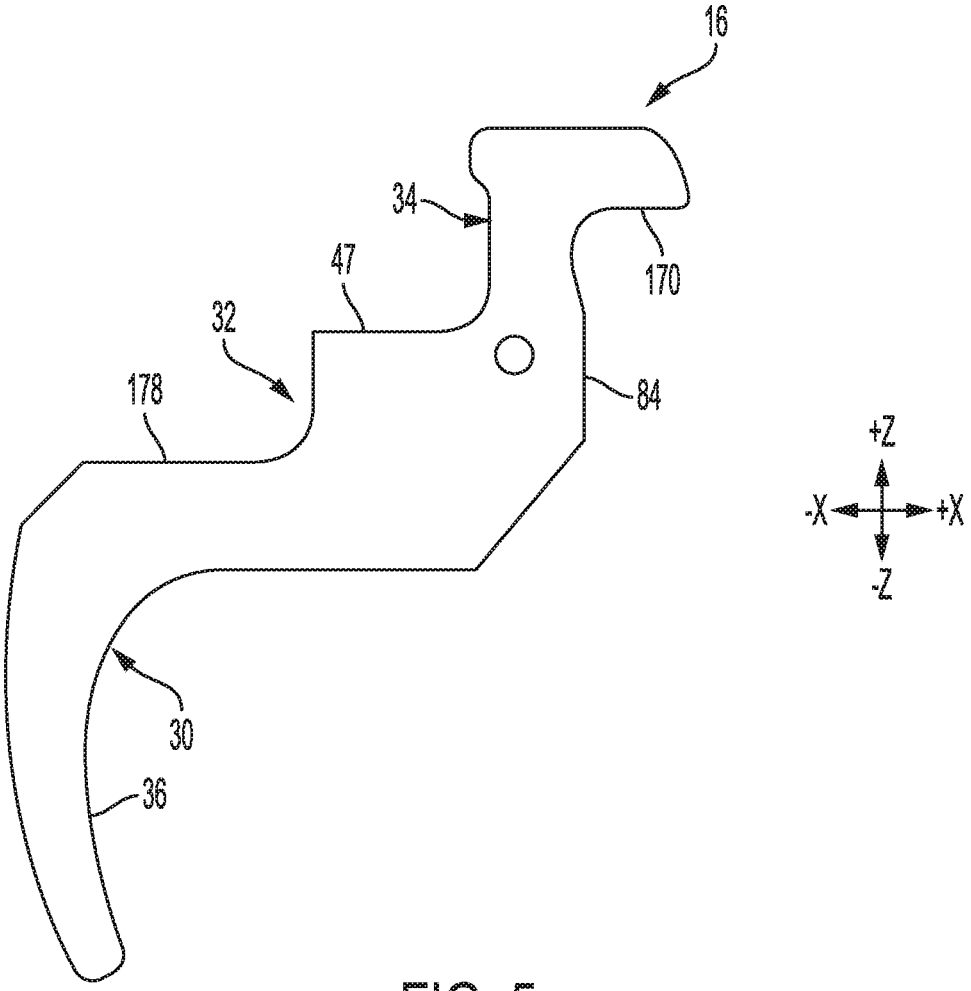
FIG. 5 is a right side view of a trigger lever of the trigger assembly shown in FIGS. 2-4.

Referring to FIG. 5, the trigger lever 16 has a first portion 30, an adjoining second portion 32, and a third portion 34 that adjoins the second portion 32. The first portion 30 is elongated, and extends generally downward. The first portion 30 has a substantially flat, generally forward-facing surface 36. The surface 36 acts as a contact surface against which the user exerts pressure to rotate the trigger lever 16 and initiate the firing sequence for the rifle 100, as discussed below. The second portion 32 has a substantially flat upper surface 47 that, as explained below, acts as an interface with the re-cocking lever 18.

Figure 2:
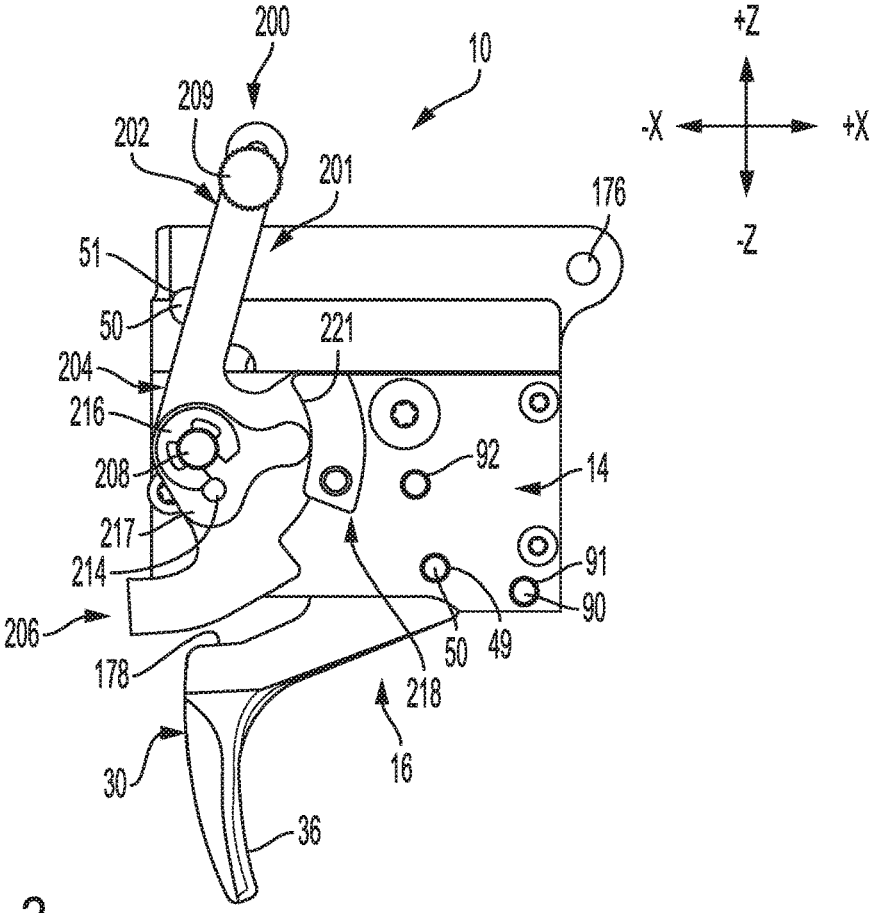
FIG. 2 is a right side view of the trigger assembly of the rifle shown in FIG. 1, showing a safety lever of a safety mechanism of the trigger assembly in an unlocked position.
Figure 3:
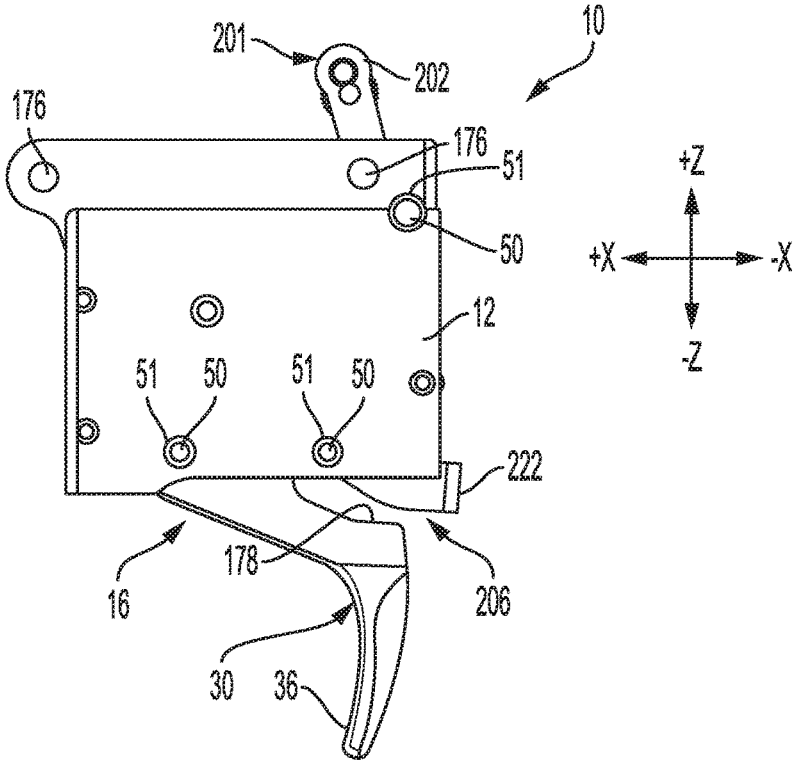
FIG. 3 is a left side view of the trigger assembly shown in FIG. 2, showing the safety lever in the unlocked position.
Figure 4:
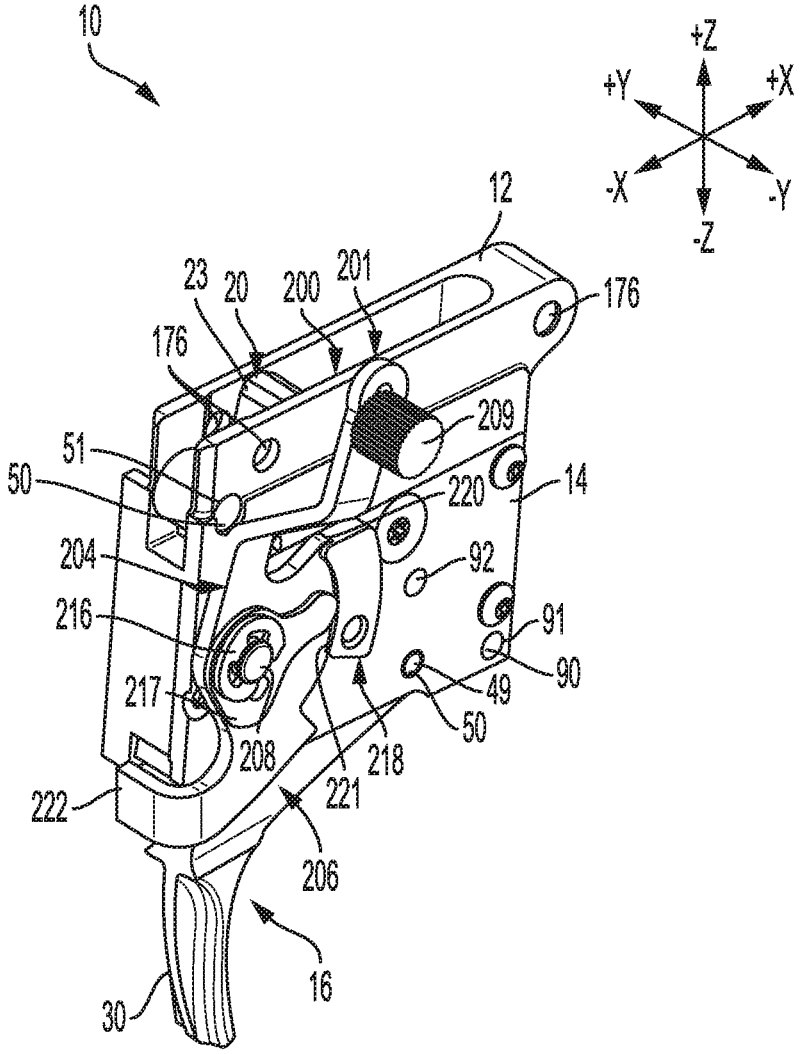
FIG. 4 is a top-rear perspective view of the trigger assembly shown in FIGS. 2 and 3, showing the safety lever in the unlocked position.

The trigger lever 16 is mounted for rotation on a pin 50, as shown in FIG. 9. A first end portion of the pin 50 is mounted in an aperture 51 formed in the housing 12, as can be seen in FIG. 3. The pin 50 is retained in the aperture 51 by an interference fit; the pin 50 can be retained by other means in alternative embodiments. A second end portion of the pin 50 is disposed in an aperture 49 formed in the cover plate 14, as can be seen in FIGS. 2 and 4. The end portions of the pin 50 are narrower than the middle portion of the pin 50; this feature helps the pin 50 to remain captive between the housing 12 and the cover plate 14.

The pin 50 extends through a bore formed in the third portion 34 of the trigger lever 16. The pin 50 and the bore are sized so that minimal clearance is present between the outer surface of the pin 50 and the periphery of the bore. This feature permits the trigger lever 16 to rotate freely on the pin 50, with minimal non-rotational motion.

Figure 5A:
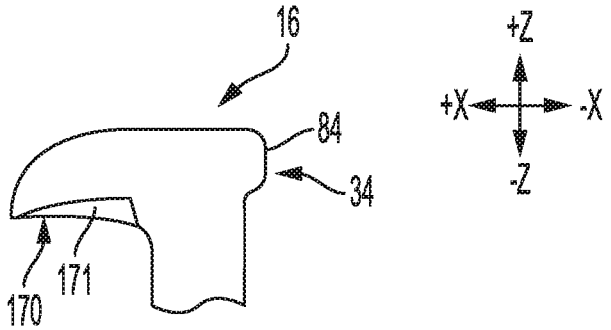
FIG. 5A is a left side view of a third portion of the trigger lever shown in FIG. 5.

The trigger lever 16 is biased in a counter-clockwise direction, from the perspective of FIG. 9, by a spring 86. As shown in FIGS. 9 and 10, the spring 86 is located within a passage 87 formed in the housing 12, below a lower surface 170 of the third portion 34 of the trigger lever 16. The spring 86 acts against the lower surface 170 via a ball 88 positioned between the spring 86 and the lower surface 170. The lower surface 170 has a bevel 171 formed therein, as shown in FIG. 5A, so that the ball 88 is held captive between the beveled portion of the lower surface 170 and the adjacent surface of the housing 12.

The non-planar spherical surface of the ball 88 permits the spring 86 to change its orientation to conform to the rotational movement of the trigger lever 16, while maintaining its linear configuration. More specifically, the spherical surface permits the spring 86 to tilt, rather than bend in relation to its axis as the trigger lever 16 rotates. Because the spring 86 does not bend, i.e., because the spring 86 remains square with respect to its axis, the load being applied to the spring 86 by the trigger lever 16 remains a compressive load applied along the axis of the spring 86. As a result, the relationship between deflection and applied force for the spring 86 remains substantially linear as the spring 86 is compressed by the rotating trigger lever 16, and the spring 86 deflects in a smooth and predictable manner. Also, the spring 86 is not susceptible to the buckling that can result from the off-axis loading of a compression spring; such buckling, in extreme cases, can result in drag, binding, and damage to the spring. The upper end of the spring 86 can be positioned against other types of non-planar surfaces, such as a curved or conical surface, instead of the spherical surface of the ball 88 in alternative embodiments.

The housing 12 has a rearward-facing interior surface 89, as can be seen in FIGS. 9 and 10. A forward-facing surface 84 on the second portion 32 of the trigger lever 16 contacts the interior surface 89 of the housing 12 when the trigger lever 16 is in its rest position, i.e., the position to which the trigger lever 16 returns when pressure on the surface 36 of the first portion 30 is removed, as shown in FIG. 9. The interior surface 89 of the housing 12 thus acts as a rest stop for the trigger lever 16.

Contact between the lower surface 170 of the third portion 34 of the trigger lever 16 and an underlying interior surface 85 of the housing 12 limits the extent to which the trigger lever 16 can rotate in the clockwise direction, as shown in FIG. 10. The interior surface 85 thus acts as an overtravel stop for the trigger lever 16.

b. Re-Cocking Lever

Figure 7:
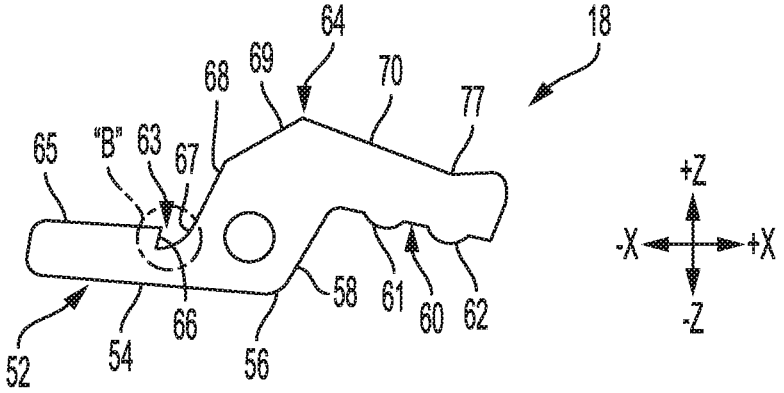
FIG. 7 is a right side view of a re-cocking lever of the trigger assembly of FIGS. 2-6.
Figure 11:
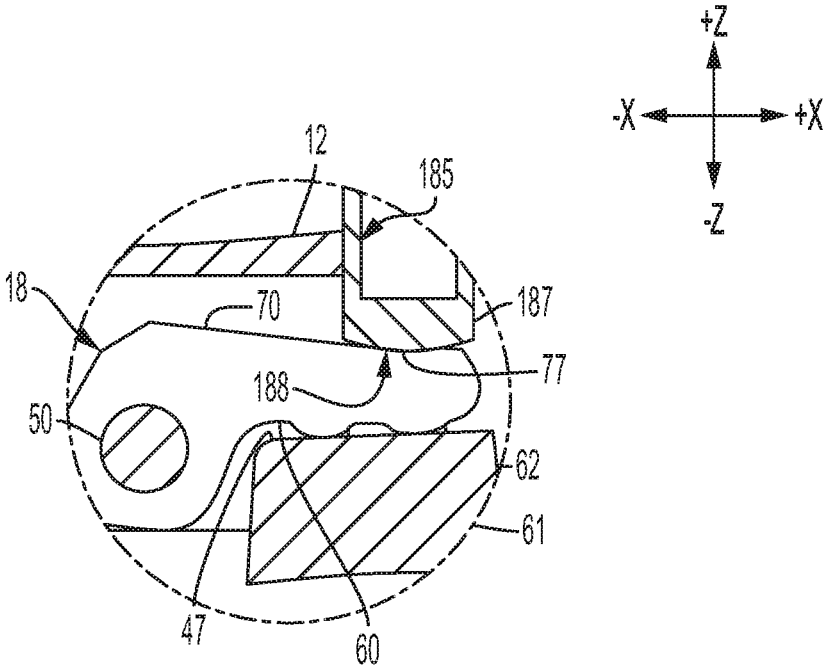
FIG. 11 is a magnified view of the area designated "C" in FIG. 9, as the trigger mechanism is transitioning from a first to a second phase of its trigger pull.

Referring to FIG. 7, the re-cocking lever 18 has a lower surface 52. The lower surface 52 includes a generally flat first portion 54; a curvilinear second portion 56 that adjoins the first portion 54; a generally flat third portion 58 that adjoins the second portion 56; and a fourth portion 60 that adjoins that third portion 58. The fourth portion 60 includes a first timing element 61 and a second timing element 62. The first and second timing elements 61, 62 are raised, rounded areas on the fourth portion 60, as can be seen in FIGS. 7 and 11. As discussed below, the first and second timing elements 61, 62 contact the upper surface 47 of the second portion 32 of the trigger lever 16 during actuation of the trigger mechanism 10.

The re-cocking lever 18 also has an upper surface 64. The upper surface 64 includes a generally flat first portion 65; a generally flat second portion 66 that adjoins the first portion 65, and is oriented generally perpendicular to the first portion 65; and a curved third portion 67 that adjoins the second portion 66. The first, second, and third portions 65, 66, 67 define a detent 63 in the re-cocking lever 18, the purpose of which is discussed below.

The upper surface 64 also includes a fourth portion 68 that adjoins the third portion 67; a fifth portion 69 that adjoins the fourth portion 68; and a sixth portion 70 that adjoins the fifth portion 69. The sixth portion 70 has a bend 77 formed therein, the purpose of which is discussed below.

The re-cocking lever 18 is mounted for rotation on another pin 50, as shown in FIG. 9. A first end portion of the pin 50 is mounted in another aperture 51 formed in the housing 12, as can be seen in FIG. 3. The pin 50 is retained in the aperture 51 by an interference fit; the pin 50 can be retained by other means in alternative embodiments. A second end portion of the pin 50 is disposed in another aperture 49 formed in the cover plate 14. The pin 50 extends through a bore formed in the re-cocking lever 18. The pin 50 and the bore are sized so that minimal clearance is present between the outer surface of the pin 50 and the periphery of the bore.

The re-cocking lever 18 is biased in a clockwise direction, from the perspective of FIG. 9, by a first spring plunger 174. Referring to FIGS. 9 and 10, the first spring plunger 174 includes a spring 184, and a cylindrical casing 185 that houses the spring 184. The casing 185 has an open first end 186, and a closed second end 187. The first spring plunger 174 is located in a bore 175 formed in the housing 12. The diameter of the bore 175 is sized so that the casing 185 can translate in its lengthwise, or "z" direction within the bore 175.

The second end 187 of the casing 185 is biased against the sixth portion 70 of upper surface 64. The second end 187 is rounded, as can be seen in FIG. 11. The sixth portion 70 of the upper surface 64 has a bend 77 formed therein, as noted above. The bend 77 is configured so that a clearance, denoted by the arrow 188 in FIG. 11, exists between a portion of the second end 187, and the sixth portion 70. The clearance is offset to one side of the centerline of the first spring plunger 174, so that the casing 185 is loaded asymmetrically about its centerline as the spring 184 urges the second end 187 of the casing 185 into the upper surface 64 of the re-cocking lever 18. As a result of the asymmetric loading, the casing 185 is slightly tilted with the bore 175, i.e., the centerline of the casing 185 is not parallel to the centerline of the bore 175. This in turn causes the casing 185 to contact the adjacent surface of the housing 12, which can dampen or eliminate rocking of the first spring plunger 174 during actuation of the trigger mechanism 10, thereby enhancing the smoothness of the trigger pull.

c. Sear Lever

Figure 6:
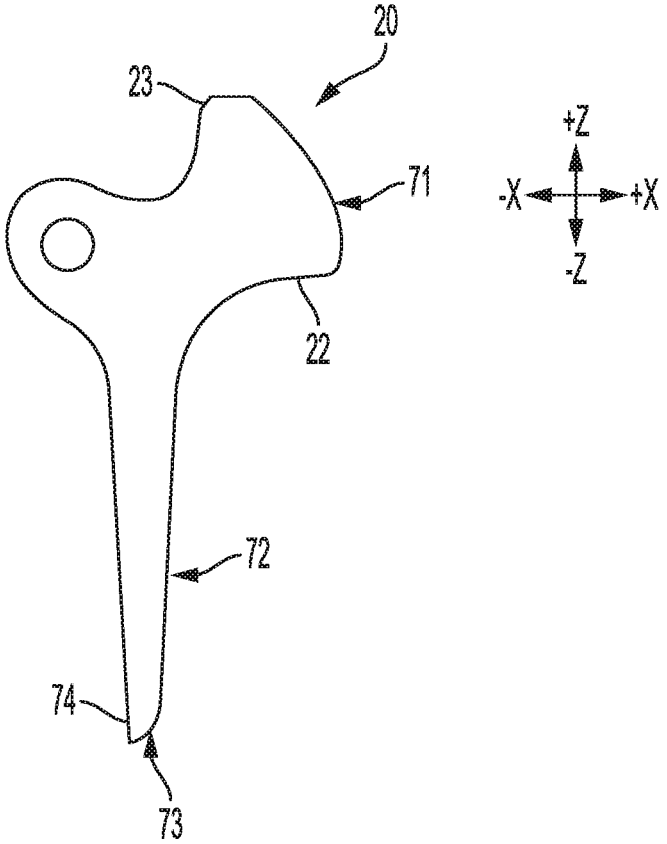
FIG. 6 is a right side view of a sear lever of the trigger assembly shown in FIGS. 2-5A.

Referring to FIG. 6, the sear lever 20 includes a body 71, and an arm 72 that adjoins, and extends generally downward from the body 71. The arm 72 has a freestanding lower end 73. The lower end 73 includes a substantially flat contact surface 74. As shown in FIG. 9, the lower end 73 is located within the detent 63 in the re-cocking lever 18 when the sear lever 20 and the re-cocking lever 18 are in their respective rest positions; and the contact surface 74 engages the second portion 66 of the upper surface 64 of the re-cocking lever 18 on a selective basis, as discussed in detail below.

Figure 12:
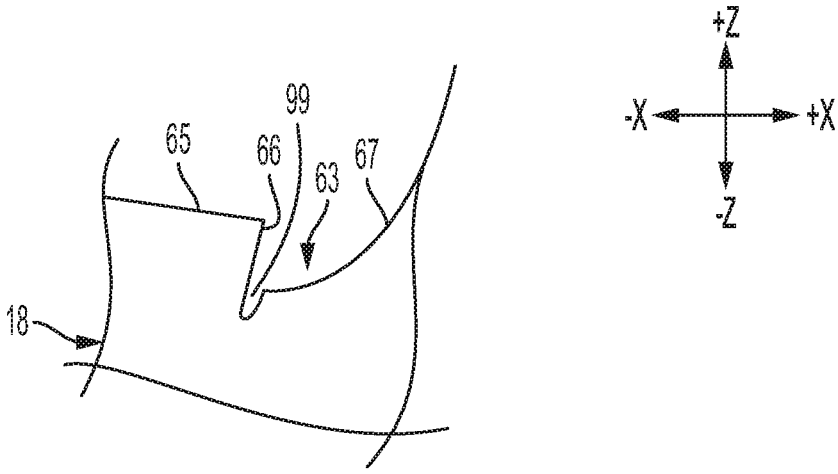
FIG. 12 is a magnified view of the area designated "B" in FIG. 7.

Due to the need for the second portion 66 of the upper surface 64 of the re-cocking lever 18 to separate cleanly and reliably from the contact surface 74 of the sear lever 20, the detent 63 in the re-cocking lever 18 includes a channel portion 99, visible in FIG. 12. The channel portion 99 forms a minor volume below the remaining portion of the detent 63; the channel portion 99 can receive dirt and other contaminants that otherwise could accumulate within the detent 63, and interfere with the proper mechanical interaction between the second portion 66 of the upper surface 64 and the contact surface 74.

As can be seen in FIG. 6, the thickness, or "x" dimension of the arm 72 varies along the height, or "z" dimension of the arm 72, with the thickness increasing linearly between the lower end 73, and the portion of the arm 72 that adjoins the body 71. The increase in thickness along the height of the arm 72 can be non-linear in alternative embodiments. The increase in thickness causes the loading on the arm 72 to be distributed over a larger area in comparison to an arm of constant thickness. Distributing the loading over a larger area can help minimize the potential for an overstress condition in the arm 72, and a structural failure of the arm 72 which could result in a potentially deadly unintentional discharge of the rifle 100.

The sear lever 20 is mounted for rotation on another pin 50, as can be seen in FIG. 9. The first and second end portions of the pin 50 is mounted in respective apertures 51 formed in the housing 12, as can be seen in FIGS. 2-4. The pin 50 is retained in the apertures 51 by an interference fit; the pin 50 can be retained by other means in alternative embodiments.

The pin 50 extends through a bore formed in the sear lever 20. The pin 50 and the bore are sized so that minimal clearance is present between the outer surface of the pin 50 and the periphery of the bore. This feature permits the sear lever 20 to rotate freely on the pin 50, with minimal non-rotational motion.

The sear lever 20 is biased in a counter-clockwise direction, from the perspective of FIG. 9, by a second spring plunger 189. The second spring plunger 189 is substantially identical to the first spring plunger 174, and has a spring 184 disposed within a casing 185 as discussed above in relation to the first spring plunger 174. Referring to FIGS. 9 and 10, the second spring plunger 189 is located in a bore 191 formed in the housing 12. The diameter of the bore 191 is sized so that the casing 185 of the second spring plunger 189 can translate in its lengthwise, or "z" direction within the bore 191.

The second end 187 of the casing 185 of the second spring plunger 189 is biased against a lower surface 22 of the body 71. As can be seen in FIG. 9, the curved shape of the second end 187, in conjunction with the angled orientation of the lower surface 22 in relation to the horizontal, or "x" direction, results in a clearance, denoted by the arrow 190 in FIG. 9, between the second end 187 and the lower surface 22, with the clearance being offset to one side of the centerline of the second spring plunger 189. Due to the asymmetric clearance, the casing 185 is loaded asymmetrically about its centerline as the spring 184 urges the second end 187 of the casing 185 into the lower surface 22 of the body 71, and the casing 185 is slightly tilted within the passage 191. This in turn causes the casing 185 to contact the adjacent surface of the housing 12, which can dampen or eliminate rocking of the second spring plunger 174 during actuation of the trigger mechanism 10, thereby enhancing the smoothness of the trigger pull.

The body 71 of the sear lever 20 has a contact surface 23. The contact surface 23 engages a contact surface 134 on the lip 127 on the cocking piece 112 when the bolt assembly 102 is in its closed position. The contact surface 134 is angled by, for example, approximately 27 degrees in relation to the horizontal, i.e., the "x" direction; and the contact surface 23 of the sear lever 20 is similarly oriented, so that the overlapping portions of the contact surface 134 and the contact surface 23 lie substantially flat against each other.

The contact surface 134 of the cocking piece 112 comes into contact with the contact surface 23 of the sear lever 20 as the bolt assembly 102 is moved forward, toward its closed position. The engagement of the contact surface 134 by the contact surface 23 restrains the cocking piece 112 and the attached firing pin 106 from further forward movement. The contact surface 134 and the contact surface 23 remain engaged until the trigger assembly 10 is actuated, at which point the cocking piece 112 and the firing pin 106 are free to move forward under the bias of the spring of the striker 105, toward the unfired cartridge in the barrel chamber 128.

Due to the angled orientations of the contact surface 134 and the contact surface 23, the cocking piece 112 exerts a force on the sear lever 20 that acts in the forward ("+x") and downward ("−z") directions. The cocking piece 112 thereby biases the sear lever 20 in a clockwise direction from the perspective of FIG. 9. The engagement of the contact surface 74 of the arm 72 of the sear lever 20, and the second portion 66 of the upper surface 64 of the re-cocking lever 18 counteracts the torque exerted on the sear lever 20 by the cocking piece 112; this prevents the sear lever 20 from rotating in a clockwise direction, which in turn prevents the sear lever 20 from disengaging from the cocking piece 112.

d. Housing and Cover Plate

Figure 13:
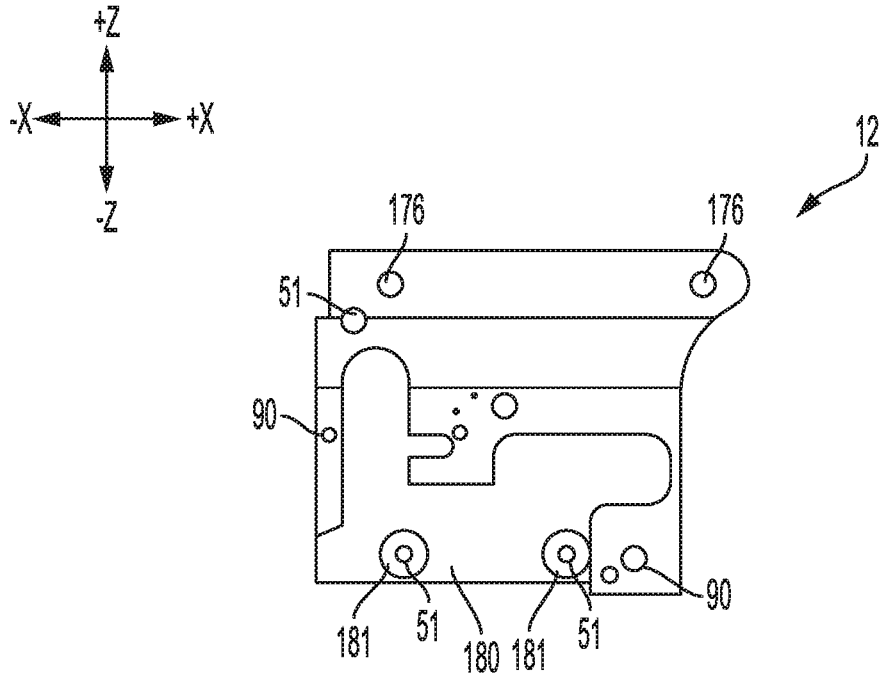
FIG. 13 depicts an interior surface of a housing of the trigger assembly of FIGS. 2-12.
Figure 14:
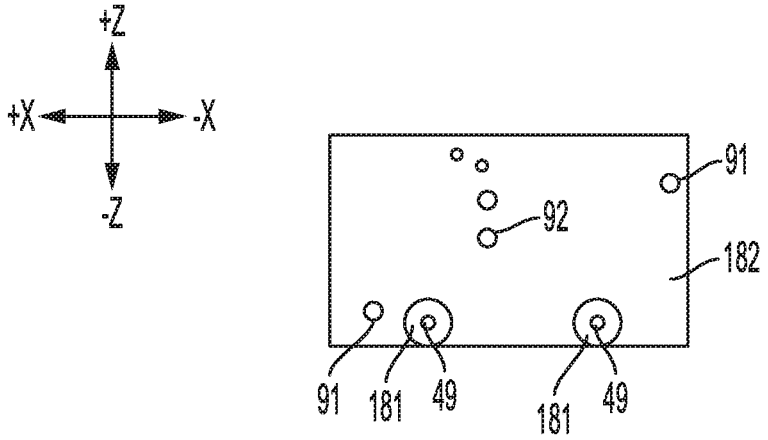
FIG. 14 depicts an interior surface of a cover plate of the trigger assembly of FIGS. 2-13.

The housing 12 has two cylindrical alignment posts 90 integrally formed therein, as shown in FIG. 13. The alignment posts 90 are received in apertures 91 formed in the cover plate 14, as shown in FIGS. 2, 4, and 14. The alignment posts 90 and the apertures 91 are sized so that no substantial clearance is present between the outer circumferential surface of each alignment post 90 and the adjacent surface of the cover plate 14. The alignment posts 90 resist shear loads that may occur between the housing 12 and the cover plate 14, and thereby help to maintain the housing 12 and the cover plate 14 in a state of alignment. This feature reduces the potential for the pins 50 associated with the trigger lever 16 and the re-cocking lever 18 to be subject to the noted shear loads. Subjecting the pins 50 to such loading potentially can impair the ability can trigger lever 16 and re-cocking lever 18 to rotate freely and smoothly, which in turn can lead to binding and premature wear of the trigger assembly 10, excessive trigger pull weight, rough and uneven trigger pull, and reduced accuracy for the rifle 100.

The alignment posts 90 can be formed separately from the housing 12 in alternative embodiments. In other alternative embodiments, the alignment posts 90 can be formed in the cover plate 14, and the apertures 91 can be formed in the housing 12.

The cover plate 14 is secured to the housing 12 by a plurality of fasteners. The cover plate 14 has an aperture 92 formed therein and depicted in FIGS. 2, 4, and 14. The aperture 92 has an internal thread pattern that matches the external thread pattern on the fasteners. The aperture 92 is aligned with, i.e., is positioned opposite, a relatively thick and solid portion of the housing 12. After the fasteners are removed during disassembly of the trigger assembly 10, one of the fasteners can be screwed into the aperture 92 so that the end of the screw urges the housing 12 and the cover plate 14 away from each other. This feature thus can assist the user or maintainer in removing the cover plate 14 from the housing 12 without the need to pry the components apart, thereby eliminating the potential for damage to the cover plate 14 or the housing 12 which often results from prying.

As noted above, the housing 12 and the cover plate 14 have apertures 51, 49 formed therein that receive the pins 50 upon which the trigger lever 16, re-cocking lever 18, and sear lever 20 are mounted. An interior surface 180 of the housing 12 has a raised areas 181 located around the apertures 51 in the housing 12, as shown in FIG. 13. An interior surface 182 of the cover plate 14 likewise has raised areas 181 located around the apertures 49 in the cover plate 14, as shown in FIG. 14.

The raised areas 181 on the housing 12 form the contact areas between the housing 12, and one of the respective sides of the trigger lever 16, re-cocking lever 18, and sear lever 20. The raised areas 181 on the cover plate 14 likewise form the contact areas between the cover plate 14, and the other respective sides of the trigger lever 16 and the re-cocking lever 18. The raised areas 181 on the housing 12 minimize the contact area between the housing 12, and the trigger lever 16, re-cocking lever 18, and sear lever 20. The raised areas 181 on the cover plate 14 likewise minimize the contact area between the cover plate 14, and the trigger lever 16 and the re-cocking lever 18. The raised areas 181 thereby can reduce friction resulting from the rotation of the trigger lever 16, re-cocking lever 18, and sear lever 20 in relation to the housing 12 and cover plate 14; and can lower the potential for binding of the trigger lever 16, re-cocking lever 18, and sear lever 20. In alternative embodiments, the raised areas 181 can be formed on the sides of the trigger lever 16, re-cocking lever 18, and sear lever 20 instead of, or in addition to the interior surface 180 the housing 12 and the interior surface 182 of the cover plate 14.

Figure 15:
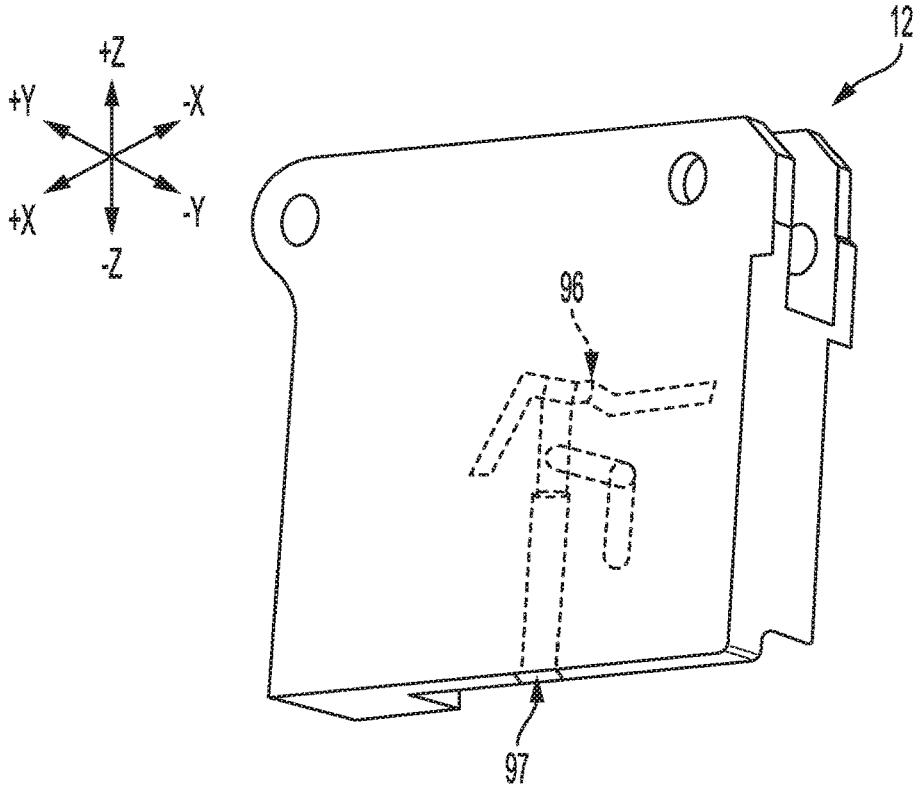
FIG. 15 is a left-bottom perspective view of a housing of the trigger mechanism shown in FIGS. 2-14.
Figure 16:
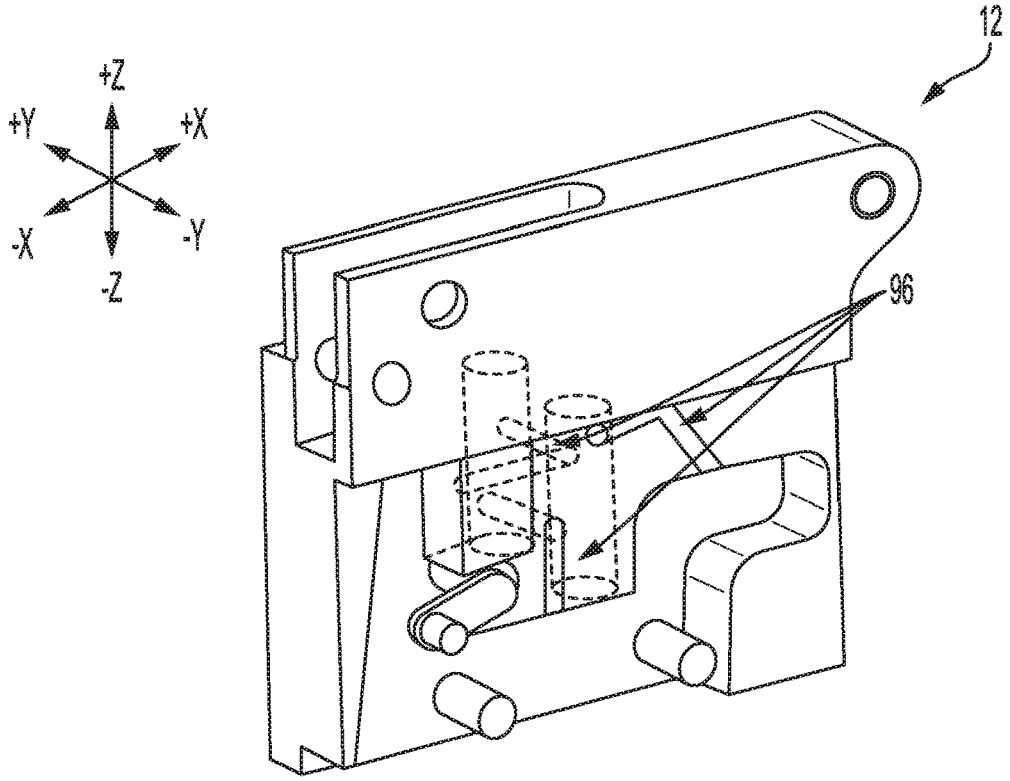
FIG. 16 is a right-top perspective view of a housing of the trigger mechanism shown in FIGS. 2-15.

Referring to FIGS. 15 and 16, the housing 12 has internal passages 96 formed therein to facilitate the distribution of cleaning fluid and compressed air throughout the interior of the trigger assembly 10. The passages 96 are in fluid communication with a port 97 located on the bottom of the housing 12. The port 97 can receive a tube or other means for introducing the cleaning fluid or compressed air into the passages 96. The passages 96 extend to locations within the housing 12 that allow the cleaning fluid and compressed air to reach, for example, the respective pivot points for the trigger lever 16, re-cocking lever 18, and sear lever 20; other areas on the trigger lever 16, re-cocking lever 18, and sear lever 20 that contact the housing 12 and the cover plate 14; and the areas on the trigger lever 16, re-cocking lever 18, and sear lever 20 that contact each other.

The ability to introduce cleaning fluid and compressed air to various locations within the trigger assembly 10 without the need to disassemble the trigger assembly 10 can reduce the time and effort needed to clean the trigger assembly 10; can lead to more frequent cleaning of the trigger assembly 10; and can make it possible to clean the trigger assembly 10 under field conditions in which cleaning otherwise would not be feasible.

e. Actuation of the Trigger Mechanism

Actuation of the trigger assembly 10 initiates the firing sequence for the rifle 100. FIG. 9 depicts the various components of the trigger assembly 10 in their respective rest positions, prior to actuation of the trigger assembly 10. FIG. 10 shows the components in their respective positions immediately after actuation.

The user actuates the trigger assembly 10 by exerting a rearward force on the surface 36 of the first portion 30 of the trigger lever 16, causing the trigger lever 16 to rotate in a clockwise direction from the perspective of FIG. 9. The trigger lever 16 imparts rotation to the re-cocking lever 18 by way of the first and second timing elements 61, 62; and the use of two timing elements 61, 62 produces a two-stage trigger pull, as follows.

FIG. 9 shows the trigger assembly 10 prior to rotation of the trigger lever 16, with the various movable components of the trigger member 10 in their respective rest positions. The clockwise rotation of the trigger lever 16 causes the upper surface 47 of the second portion 32 of the trigger lever 16 to move in a generally upward direction. As depicted in FIG. 9, the second timing element 62 is in contact with the upper surface 47 of the second portion 32 of the trigger lever 16, and the first timing element 61 is not in contact with the trigger lever 16, when the trigger lever 16 and the re-cocking lever 18 are in their rest positions. Thus, the upward movement of the upper surface 47 initially imparts counter-clockwise rotation to the re-cocking lever 18 by way of the second timing element 62.

Continued clockwise rotation of the trigger lever 16 causes the second timing element 62 to rotate in relation to the upper surface 47 of the second portion 32 of the trigger lever 16, imparting further rotation to the re-cocking lever 18. Because the second timing element 62 is located farther from the axis of rotation of the trigger lever 16 than the first timing element 61, the clockwise rotation of the trigger lever 16 eventually brings the first timing element 61 into contact with the upper surface 47, as shown in FIG. 11. This point marks the end of the first stage, and the beginning of the second stage of the trigger pull. Further rotation of the trigger lever 16 causes the second timing element 62 to come out of contact with the upper surface 47 of the trigger lever 16; after this point, the trigger element 16 imparts rotation to the re-cocking lever 18 solely by way of the first timing element 61.

Because the first timing element 61 is located closer to the axis of rotation of the re-cocking lever 18 than the second timing element 62, the moment arm through which the trigger lever 16 applies force to the first timing element 61 is shorter than the moment arm through which the trigger lever 16 applies force to the second timing element 62. The user, therefore, feels an abrupt increase in the trigger pull weight at the transition from the first to the second phase of the trigger pull; and the increased trigger pull weight continues to be present throughout the second phase of the trigger pull.

Continued clockwise rotation of the trigger lever 16 through the second stage of the trigger pull causes the re-cocking lever 18 to rotate further in the counter-clockwise direction, which in turn decreases the degree of overlap between the second portion 66 of the upper surface 64 of the re-cocking lever 18, and the contact surface 74 of the sear lever 20. As discussed above and as shown in FIG. 9, the second portion 66 of the upper surface 64 acts as a lip that restrains the sear lever 20 from clockwise rotation, which in turn prevents the sear lever 20 from rotating to release the cocking piece 112.

The counter-clockwise rotation of the re-cocking lever 18 eventually eliminates the overlap between the second portion 66 of the upper surface 64, and the contact surface 74. At this point, depicted in FIG. 10, the sear lever 20 is free to rotate clockwise, and rotates in that direction in response to the force exerted on the sear lever 20 by the cocking piece 112 through the angled contact surface 134 of the cocking piece 112, and the similarly-angled contact surface 23 of the sear lever 20. The rotation of the sear lever 20 causes contact surface 23, which had been restraining the cocking piece 112 from forward movement, to move out of contact with the contact surface 134. The cocking piece 112, and the attached firing pin 106, are then free to move forward under the bias of the spring of striker 105. As discussed above, firing pin 106 subsequently strikes the primer of the unfired cartridge in the barrel chamber 128 to initiate the discharge of the rifle 100.

The first and second timing elements 61, 62 of the re-cocking lever 18 have substantially identical dimensions. The dimensions and locations of one or both of the first and second timing elements 61, 62 can be varied in other embodiments of the re-cocking lever 18, to change the point in the trigger pull at which the transition between the first and second stages occurs, and/or to change the trigger pull weight during the first and second stages.

Alternative embodiments of the trigger assembly 10 can be configured to produce a single-stage trigger pull, i.e., a trigger pull in which the trigger pull weight remains substantially constant throughout the trigger pull. This can be accomplished by configuring the re-cocking lever 20 with one timing element instead of two. In other alternative embodiments, the first and second timing elements 61, 62 can be located on the upper surface 47 of the second portion 32 of the trigger lever 16. In still other alternative embodiments, one of the first and second timing element 61, 62 can be located on the re-cocking lever 18, and the other timing element 61, 62 can be located on the trigger lever 16.

Following discharge of the cartridge, the user can decrease or remove finger pressure on the surface 36 of the trigger lever 16. This will allow the trigger assembly 10 to reset to the state shown in FIG. 9, as follows: the re-cocking lever 18 will rotate in a clockwise direction under the bias of the first spring plunger 174, to its rest position; the sear lever 20 will rotate in a counter-clockwise direction under the bias of the second spring plunger 189, to its rest position; and the trigger lever 16 will rotate in a counter-clockwise direction under the bias of the spring 86, to its rest position. Also, as can be seen in FIG. 11, the lower end 73 of the arm 72 of the sear lever 20 will return to its position within the detent 63.

f. Safety Mechanism

The trigger assembly 10 also comprises a safety mechanism 200 comprising a safety lever 201 mounted on the exterior of the housing 12. A substantial entirety of the safety mechanism 200 is located external to the housing 12 and the cover plate 14, giving the trigger assembly 10 a more compact overall footprint that a comparable trigger mechanism having a safety mechanism located partly or entirely within the trigger mechanism.

Figure 17:
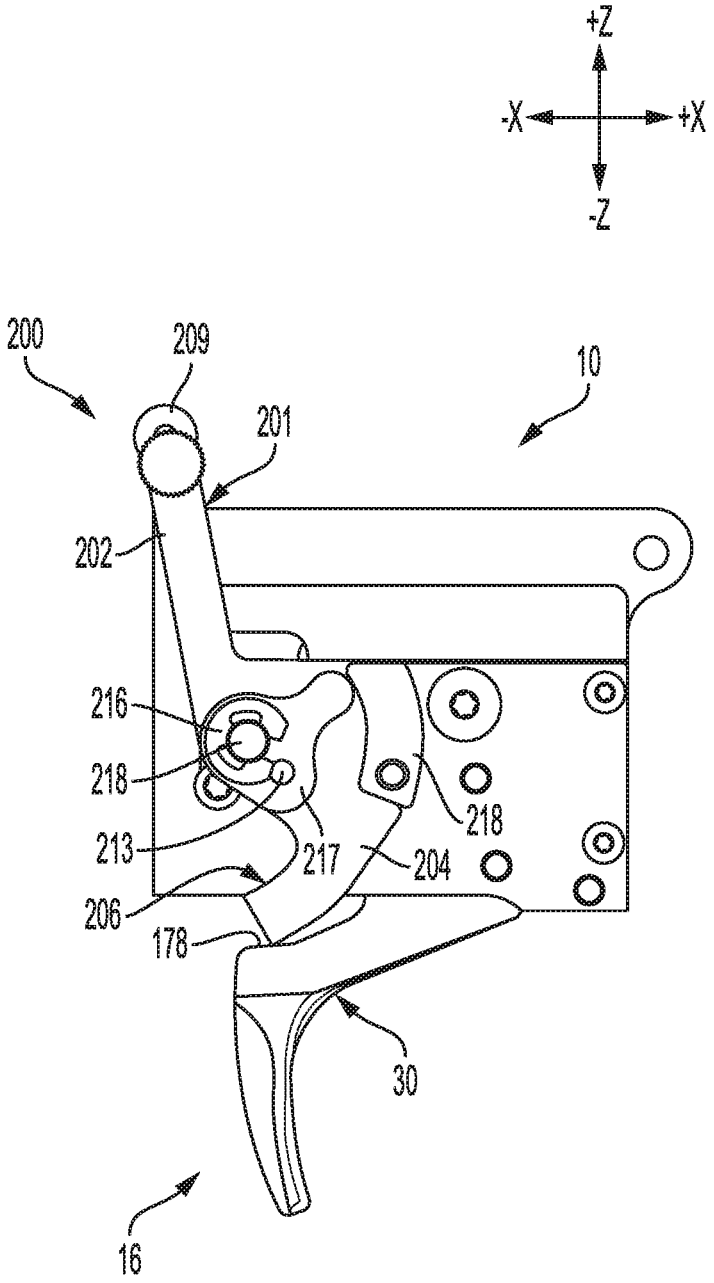
FIG. 17 is a right side view of the trigger assembly shown in FIGS. 2-16, showing the safety lever in the locked position.

Referring to FIGS. 2 and 17, the safety lever 201 has a first, or upper portion 202; a second, or middle portion 204 that adjoins the upper portion 202; and a third, or lower portion 206 that adjoins the middle portion 204. The safety lever 201 is mounted for rotation on the cover plate 14 by way of a projection 208 on the cover plate 14. The middle portion 204 has an aperture formed therein that receives the projection 208. The safety lever 201 is retained on the projection 208 by a retaining tab 216 that securely engages the projection 208 by way of a groove (not shown) in the projection 208. The safety lever 201 is movable between a first, or unlocked position shown in FIGS. 2-4; and a second, or locked position depicted in FIG. 17. The upper portion 202 has a knob 209 located at the end thereof. The user can exert pressure on the knob 209 to move the safety lever 201 between its locked and unlocked positions.

Figure 8:
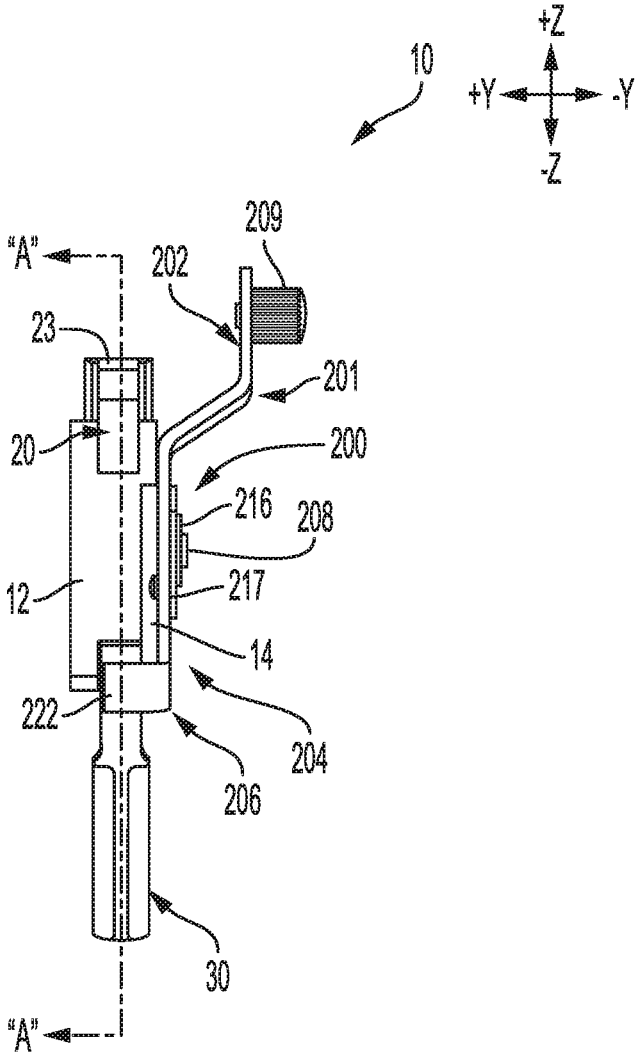
FIG. 8 is a rear view of the trigger assembly shown in FIGS. 2-7, showing the safety lever in the unlocked position.

The safety mechanism 200 also includes a tab 217. As can be seen in FIGS. 4 and 8, the tab 217 is mounted on the projection 208 of the housing 12, between the middle portion 204 of the safety lever 201 and the retaining tab 216, by way of a first aperture formed in the tab 217. The tab 217 has a second aperture formed therein. The second aperture receives a projection 214 formed on the middle portion 204 of the safety lever 201, as shown in FIG. 2. The projection 214 is sized to fit within the second aperture with no substantial clearance, so that the projection 214 causes the tab 217 to rotate with the safety lever 201.

The cover plate 14 includes a curvilinear retaining element or guide 218. The guide 218 is integrally formed with the remainder of the cover plate 14. The guide 218 can be formed separately from the rest of cover plate 14, and can be fastened to cover plate 14 in alternative embodiments.

The guide 218 includes an inner surface 220, and a lip 221 that extends from the surface 220. As can be seen FIGS. 2 and 4, an outer edge of the middle portion 204 of the safety lever 201 contacts, and is held captive by the surface 220 and the lip 221 as the safety lever 201 moves between its locked and unlocked positions. This contact discourages wobble, shimmy, and other unwanted deflection of the safety lever 201 as the safety lever 201 is rotated. The guide 218 thereby can help to ensure full and positive engagement of the safety lever 201 in its locked and unlocked positions; can reduce wear on the safety lever 201 and the projection 208; can reduce the noise generated by the movement of the safety lever 201; and can provide a smoother feel to the user as the user moves the safety lever 201. In addition, the tab 217 is configured so that an edge of the tab 217 engages the lip 221 as the tab 217 rotates with the safety lever 201, further discouraging unwanted deflection of the safety lever 201.

The safety mechanism 200, when in its locked position, interferes with the movement of three different components of the trigger assembly 10, each which must move to effectuate the firing sequence. The safely lever 201 thus provides three independent points of interference with the firing sequence.

Figure 18:
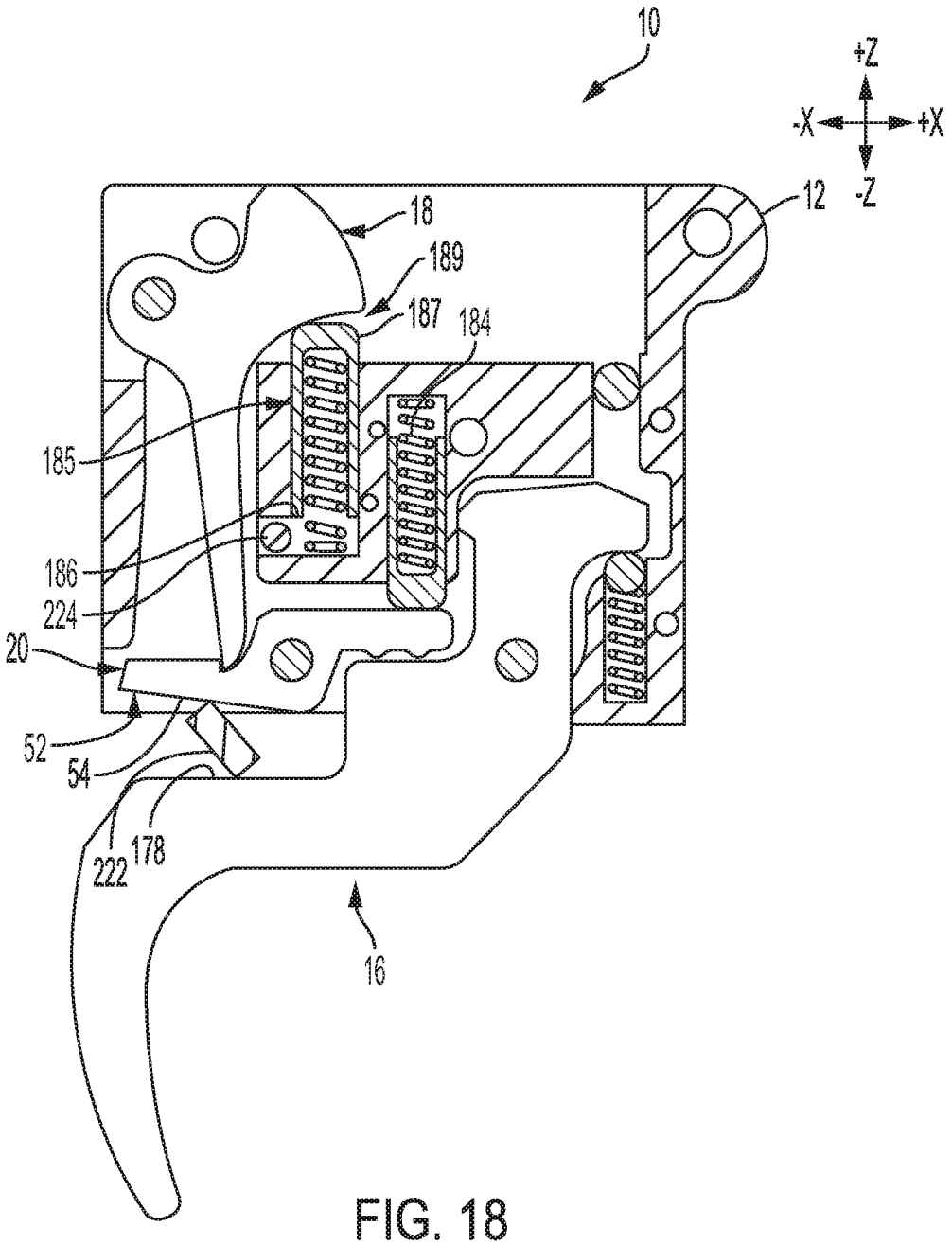
FIG. 18 is a cross-sectional view of the trigger assembly shown in FIGS. 2-17, taken through the line "A-A" of FIG. 8, showing: the safety lever in the locked position; the trigger lever, the re-cocking lever, and the sear lever in their respective rest positions; and the cocking piece of the rifle being restrained by the sear lever.

Referring to FIGS. 3, 4, 9, 17, and 18, the lower portion 206 of the safety lever 201 includes an interfering member in the form of a tab 222. The tab 222 is substantially perpendicular to the remainder of the lower portion 206. The safety lever 201 is configured so that the tab 222 becomes positioned directly above, and in close proximity to an upper surface 178 of the first portion 30 of the trigger lever 16 when the safety lever 201 is moved to its locked position, as shown in FIGS. 17 and 18. In addition, the tab 222 is positioned directly below, and in close proximity to the first portion 54 of the lower surface 52 of the re-cocking lever 18 when the safety lever 201 is in its locked position, as can also be seen in FIGS. 17 and 18.

The tab 222 thus interferes both with clockwise rotation of the trigger lever 16, and counter-clockwise rotation of the re-cocking lever 18, from the perspective of FIG. 18, when the safety lever 201 is in its locked position. As discussed above, the trigger lever 16 must rotate clockwise, and the re-cocking lever 18 must rotate counter-clockwise for the trigger assembly 10 to release the cocking piece 112 and initiate the firing sequence of the rifle 100. The safety lever 201, by preventing such rotation to occur in any substantial amount, thus inhibits initiation of the firing sequence at two separate points within the linkage of the trigger assembly 10. These firing restrictions can be removed by moving the safety lever 201 to the unlocked position shown in FIGS. 2-4; this causes the tab 222 to move generally rearward, and out of close proximity to the upper surface 178 of the first portion 30 of the trigger lever 16, and the first portion 54 of the lower surface 52 of the re-cocking lever 18, as shown in FIG. 9. The interfering member on the lower portion 206 of the safety lever 201 can take a form other than the tab 222 in alternative embodiments.

The middle portion 204 of the safety lever 201 has an interfering member in the form of a tab 224 formed thereon. The tab 224 provides a third point of interference that inhibits the trigger assembly 10 from initiating the firing sequence when the safety lever 201 is in its locked position. The tab 224 extends through a slot (not shown) in the cover plate 14. The safety lever 201 is configured so that the tab 224 becomes positioned directly below, and in close proximity to an edge of the first end 186 of the casing 185 of the second spring plunger 189 when the safety lever 201 is moved to its locked position, as shown in FIG. 18. The tab 224 thereby inhibits downward movement of the casing 185 from the position shown in FIG. 18, which in turn results in interference between the casing 185 and the sear lever 20 that prevents clockwise movement of the sear lever 20.

As discussed above, the sear lever 20 must rotate in the clockwise direction, from the perspective of FIG. 18, to release the cocking piece 112 and initiate the firing sequence of the rifle 100. The safety lever 201, by preventing such rotation, thus inhibits initiation of the firing sequence at a third point within the linkage of the trigger assembly 10. This firing restriction can be removed by moving the safety lever 201 to the unlocked position shown in FIGS. 2-4; this causes the tab 224 to move generally rearward, and out of close proximity to the first end 186 of the casing 185, as shown in FIG. 9. The interfering member on the middle portion 204 of the safety lever 201 can take a form other than the tab 224 in alternative embodiments.

The safety mechanism 200, with one movement of the safety lever 201, thus provides a three point interlock that, when engaged, prevents the trigger assembly 10 from being actuated. The safety mechanism 200 thereby can provide an enhanced level of safety against an accidental discharge of the rifle 100 in comparison to a conventional safety having one, or even two points of interfering contact. Also, the safety mechanism 200 provides this three-point safety interlock without consuming any appreciable amount of space within the housing 12.

We claim:

1. A trigger assembly for restraining a firing pin of a firearm on a selective basis, the trigger assembly comprising:

a housing;

a first lever mounted for rotation on the housing and movable in a first angular direction between a first and a second angular position of the first lever;

a second lever mounted for rotation on the housing and movable in a second angular direction between a first and a second angular position of the second lever, wherein: the second angular direction is opposite the first angular direction; and the first lever is configured to move the second lever from the first to the second angular position of the second lever by direct contact with the second lever when the first lever moves from the first to the second angular position of the first lever; and a safety mechanism comprising: a first interfering member configured to be positioned between the first and the second levers on a selective basis so that the first interfering member, when positioned between the first and the second levers, simultaneously interferes with movement of the first lever from the first to the second angular position of the first lever by direct contact with the first lever, and movement of the second lever from the first to the second angular position of the second lever by direct contact with the second lever.

2. The trigger assembly of claim 1, wherein:

the safety mechanism further comprises a safety lever mounted for rotation in relation to the housing and movable between a first and a second angular position of the safety lever;

the safety lever comprises the first interfering member; and the safety lever is configured so that the first interfering member is positioned between the first and the second levers when the safety lever is in the second angular position of the safety lever.

3. The trigger assembly of claim 2, further comprising a third lever mounted for rotation on the housing and movable between a first and a second angular position of the third lever; wherein:

the second lever is configured to move the third lever from the first to the second angular position of the third lever when the second lever moves from the first to the second angular position of the second lever;

the safety lever further comprises a second interfering member configured to be positioned in proximity to the third lever when the safety lever is in the second angular position of the safety lever, so that the second interfering member interferes with movement of the third lever from the first to the second angular position of the third lever.

4. The trigger assembly of claim 3, further comprising a cover plate mounted on the housing, wherein the safety lever is mounted for rotation on an exterior of the cover plate.

5. The trigger assembly of claim 4, wherein the second interfering member is configured to extend through an aperture in the cover plate and into an interior of the housing.

6. The trigger assembly of claim 4, further comprising a guide located on the cover plate and configured to engage the safety lever as the safety lever moves between the first and the second angular positions of the safety lever.

7. The trigger assembly of claim 4, wherein the housing includes a first and a second alignment post each configured to engage the cover plate and to maintain the housing and the cover plate in a state of alignment.

8. The trigger assembly of claim 4, wherein the housing and the cover plate each have a plurality of raised surface portions formed thereon, and the housing and the cover plate contact at least one of the first, the second, and the third levers by way of the plurality of raised surface portions.

9. The trigger assembly of claim 4, wherein at least one of the first, the second, and the third levers has a plurality of raised surface portions formed thereon, and at least one of the first, the second, and the third levers contacts the housing and the cover plate by way of the plurality of raised surface portions.

10. The trigger assembly of claim 4, wherein the cover plate has a threaded aperture formed therein and is positioned adjacent a solid surface of the housing.

11. The trigger assembly of claim 3, wherein the first and the second interfering members comprise tabs.

12. The trigger assembly of claim 3, wherein:

the first interfering member is configured to not interfere with movement of the first lever from the first to the second angular position of the first lever, and movement of the second lever from the first to the second angular position of the second lever when the safety lever is in the first angular portion of the safety lever; and the second interfering member is configured to not interfere with movement of the third lever from the first to the second position of the third lever when the safety lever is in the first angular portion of the safety lever.

13. The trigger assembly of claim 3, further comprising a spring plunger configured to bias the second lever toward the first angular position of the second lever; wherein the spring plunger comprises a casing, and a spring positioned at least in part within the casing.

14. The trigger assembly of claim 13, wherein the second interfering member is configured to interfere with movement of the casing when the safety lever is in the second angular position of the safety lever.

15. The trigger assembly of claim 3, wherein the third lever is configured to restrain the firing pin when the third lever is in the first angular position of the third lever.

16. The trigger assembly of claim 1, wherein the housing has a port formed in an exterior surface of the housing, and a passage formed within the housing; and the passage is in fluid communication with the port and at least one of the first and the second levers.

17. The trigger assembly of claim 1, further comprising a spring configured to bias the first lever toward the first angular position of the first lever; and a ball positioned between the spring and the first lever.

18. The trigger assembly of claim 17, wherein the first lever has a beveled surface; and the first lever is configured so that the ball is captured between the beveled surface and the housing.

19. The trigger assembly of claim 1, wherein the first lever is a trigger lever that is configured to move from the first angular position to the second angular position of the trigger lever when the trigger lever is pulled.

20. The trigger assembly of claim 19, wherein the trigger lever and the second lever are configured so that pulling the trigger lever while the first interfering member is between the trigger lever and the second lever causes the trigger lever to urge the second lever toward the first interfering member.

21. The trigger assembly of claim 20, wherein the trigger lever and the second lever are configured so that pulling the trigger lever while the first interfering member is between the trigger lever and the second lever causes the trigger lever to urge the second lever into interfering contact with the first interfering member.

22. The trigger assembly of claim 21, wherein the trigger lever and the second lever are configured so that pulling the trigger lever while the first interfering member is between the trigger lever and the second lever urges the trigger lever and the second lever into interfering contact with the first interfering member from opposite directions.

23. A firearm comprising the trigger assembly of claim 1.

24. A trigger assembly for restraining a firing pin of a firearm on a selective basis, the trigger assembly comprising:

a housing;

a first lever mounted for rotation on the housing and movable between a first and a second angular position of the first lever;

a second lever mounted for rotation on the housing and movable between a first and a second angular position of the second lever, the first lever being configured to move the second lever from the first to the second angular position of the second lever when the first lever moves from the first to the second angular position of the first lever;

a third lever mounted for rotation on the housing and movable between a first and a second angular position of the third lever, the second lever being configured to move the third lever from the first to the second angular position of the third lever when the second lever moves from the first to the second angular position of the second lever;

a safety mechanism comprising a safety lever mounted for rotation in relation to the housing and movable between a first and a second angular position of the safety lever, the safety lever comprising:

a first interfering member configured to be positioned in proximity to the first and the second levers on a selective basis so that the first interfering member simultaneously interferes with movement of the first lever from the first to the second angular position of the first lever, and movement of the second lever from the first to the second angular position of the second lever; the safety lever being configured so that the first interfering member is positioned in proximity to the first and the second levers when the safety lever is in the second angular position of the safety lever; and a second interfering member configured to be positioned in proximity to the third lever when the safety lever is in the second angular position of the safety lever, so that the second interfering member interferes with movement of the third lever from the first to the second angular position of the third lever; and a spring plunger configured to bias the second lever toward the first angular position of the second lever, wherein: the spring plunger comprising a casing, and a spring positioned at least in part within the casing; an end of the casing faces a surface of the second lever; a first portion of the end contacts the surface; a second portion of the end is spaced from the surface; and the first and the second portions are located on opposite sides of a centerline of the spring plunger.

25. A firearm comprising the trigger assembly of claim 24.

* * * * *